United States Patent [19]

Dorffler

[11] Patent Number: 4,642,062

[45] Date of Patent: Feb. 10, 1987

[54] NOSE WEIGHT FOR TOY AIRCRAFT

[75] Inventor: Michael K. Dorffler, Canon City, Colo.

[73] Assignee: Damon Corporation, Needham, Mass.

[21] Appl. No.: 751,437

[22] Filed: Jul. 3, 1985

[51] Int. Cl.[4] ..... A63H 27/00

[52] U.S. Cl. ..... 446/68

[58] Field of Search ..... 446/68, 67, 66, 46, 446/61, 36, 34, 47, 48, 30, 57, 59, 155, 161; 244/16, 154, 153; 273/424, 428

[56] References Cited

U.S. PATENT DOCUMENTS

| | | | |
|---|---|---|---|
| 1,374,000 | 4/1921 | Dunn | 446/68 X |
| 3,540,149 | 11/1970 | Lowe | 446/68 X |
| 4,195,439 | 4/1980 | Kramer | 446/68 |
| 4,235,040 | 11/1980 | Trowbridge | 446/68 |

OTHER PUBLICATIONS

AG Industries, Inc., 1411 4th #727, Seattle, Wash. 98101 Ad Brochure for "White Wings" Gliders.

Tiges, Inc., Ad Brochure for "Tiger Squadron".

Paul K. Guillow, Inc., Wakefield, Mass. 01880, Ad Brochure for "Delta Wing Glider".

Stratton Air Engineering, 10859 Portal Dr., Los Alamitos, Calif. 90720, Ad Brochure for "Penny Weight Models".

*Primary Examiner*—Mickey Yu

*Attorney, Agent, or Firm*—Lahive & Cockfield

[57] ABSTRACT

A weight holder for removable and replaceable attachment to the nose portion of a toy aircraft. The weight holder is adapted to be integrally mounted to a protruding nose portion of a wing panel on a toy aircraft. The weight holder has opposed clamping jaw portions connected by a hinge element. The facing surfaces of at least one jaw has a weight-seating chamber for receiving a weighted object which is to be secured to the aircraft by the weight holder.

12 Claims, 5 Drawing Figures

NOSE WEIGHT FOR TOY AIRCRAFT

BACKGROUND OF THE INVENTION

1. Field of the Invention

This invention relates to toy model aircraft, and more particularly to toy model aircraft gliders having a removable clamping weight-holding device.

2. Description of the Prior Art

Toy aircraft are well known in the art. Nose weights are often desirable for attachment to toy aircraft, particularly gliders, as they enhance and stabilize flight. It has been customary to sometimes add weight to toy aircraft by affixing a paper clip, a clamp or similar means to the nose portion of the aircraft. However, such known weights are not believed to be integrally mounted to the aircraft while securely seating an adequate stabilizing weight.

SUMMARY OF THE INVENTION

It is therefore an object of this invention to provide a toy aircraft having a removable and replaceable clamping weight-holding device which is integrally mountable with the aircraft, and which has a chamber or seat within which a weighted object is securely held.

A further object of this invention is to provide an attractive, low cost weight holder for a toy aircraft which will not detract appreciably from the aerodynamics of the aircraft.

It is also an object of this invention to provide a weight-holding device of the above character for a toy aircraft and which can accomodate varying loads within the chamber.

Another object of this invention is to provide a clamping weight-holding device which can securely attach to a toy aircraft by positive engagement.

Finally, another object of this invention is to provide a weight holder which, when secured to a toy aircraft, enchances the interconnection of the assembled wing and fuselage panels that form the aircraft.

Other objects of the invention will be apparent to those skilled in the art upon reading this disclosure.

The invention accordingly comprises an article of manufacture possessing the features, properties, and the relation of elements exemplified in the article hereinafter described, and the scope of the invention is indicated in the claims.

In accordance with the invention, a clamping device with a weight-holding chamber is provided which may be attached to a toy aircraft. The device is particularly suited for use with an aircraft which has separate, matable wing and fuselage portions. The weight holder is a removable and replaceable device that mounts to a toy aircraft with a positive engagement and that forms a chamber which securely seats a removable weighted object to the aircraft.

The weight-holding device is constructed with first and second opposed clamping jaw members joined by a hinge, and capable of being positively engaged in registration with each other. At least one of the jaw members has a weight-seating chamber.

One weight holder according to the invention mountingly seats a disk-shaped weight such as a washer, coin or like flat, circular object within the chamber or chambers of the jaws. In operation, the weighted objects are placed in the chambers and the weight-holding device is positively engaged with the nose portion of the aircraft wing and fuselage such that the wing portion is sandwiched between the opposed jaw members, and the fuselage is mated to the wing and the weight holder. The weight-holding device is designed to fit the contour of the nose portion of the aircraft so as to not interfere appreciably with the aerodynamic design of the aircraft.

BRIEF DESCRIPTION OF THE DRAWINGS

For a fuller understanding of the nature and objects of the invention, reference should be made to the following detailed description and the accompanying drawings, in which.

DESCRIPTION OF THE PREFERRED EMBODIMENT

Figure 1:
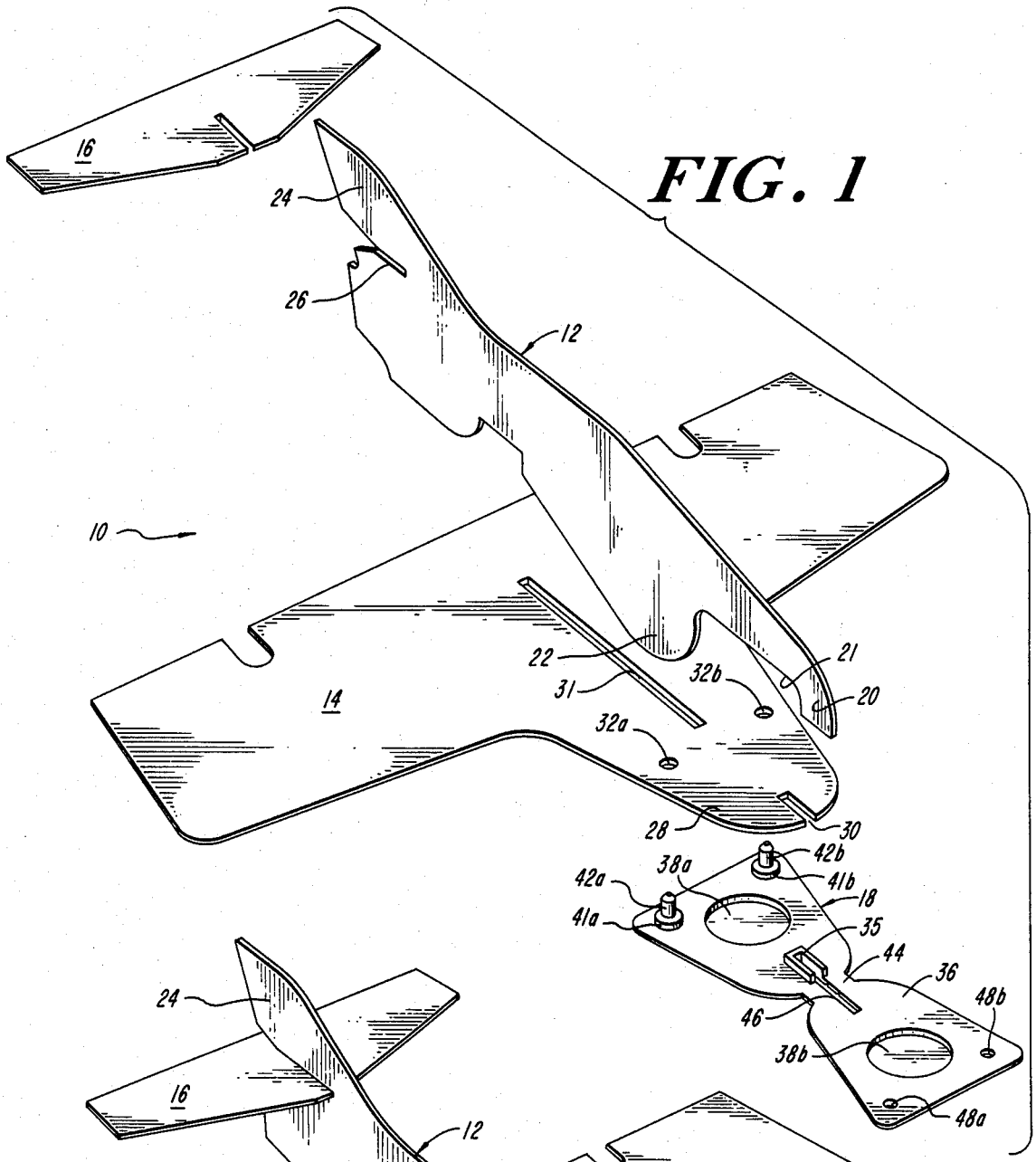
FIG. 1 is an exploded isometric view showing unassembled components of a toy aircraft, including the weight holding device of the invention.
Figure 2:
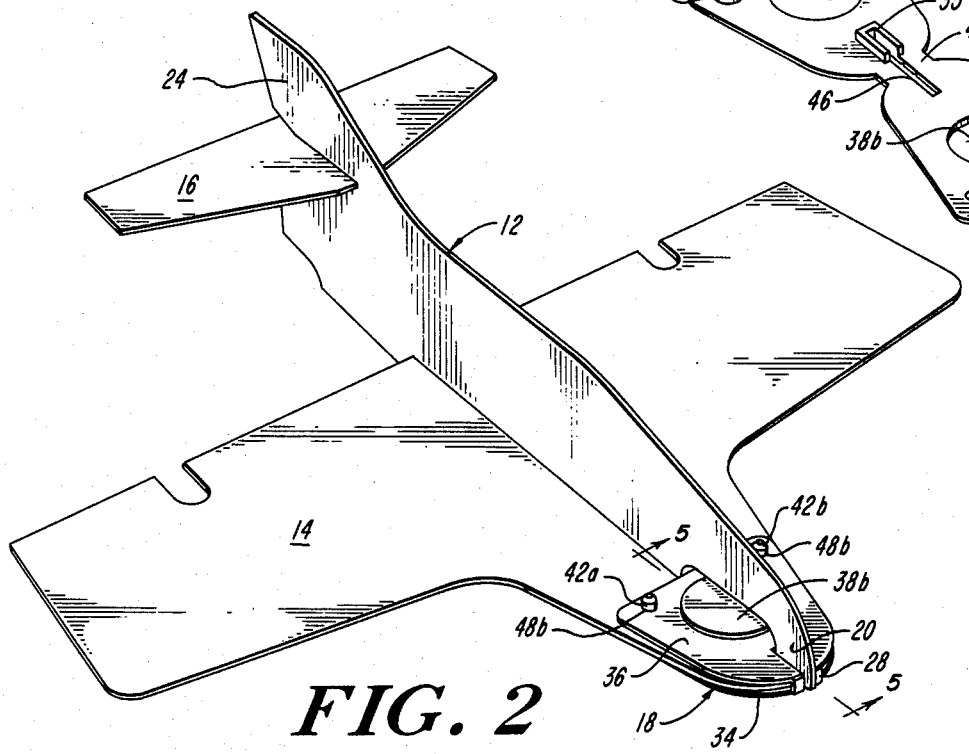
FIG. 2 is an isometric view of the assembled toy aircraft of FIG. 1 having the weight holder mounted thereto.

Referring to FIGS. 1 and 2, the toy aircraft 10 of this invention is assembled with a fuselage panel 12, a wing panel 14, a tail stabilizer 16 and a clamping weight-holding device 18. The fuselage panel 12 is an elongate, normally vertically oriented panel having a forward tab 20. A substantially centrally located downwardly projecting tab 22 on the fuselage panel interlocks with the wing panel 14, through central wing slot 31, and allows the user to conveniently hold and launch the aircraft. The illustrated fuselage panel 12 also has a rudder 24 and a rear notch 26 for receiving the tail stabilizer 16, located just below the rudder 24. The components of this aircraft may be constructed of any material conventionally used in the manufacture of toy aircraft, such as balsa, or as a perferred embodiment, foamed plastics such as polystyrene.

As shown in FIGS. 1 and 2, the wing panel 14 is normally horizontally oriented and has a protruding nose portion 28. The wing panel 14 has a notch 30 in the nose portion 28 for interlocking engagement with the forward tab 20 of the fuselage panel 12, and a central slot 31 for seatingly receiving tab 22 of the fuselage. The slot 31 and the notch 30 are aligned parallel and coaxial with one another, along the lengthwise axis of the aircraft. The area which lies between slot 31 and notch 30 is the portion of the wing upon which the weighted object 40 rests. Apertures **32*a*, 32*b* in the nose portion of the wing panel receive and secure the weight holder 18** in the manner described below. The apertures are located symmetrically on either side of the foregoing axis.

The illustrated fuselage forward tab 20 is a downwardly projecting foot at the forward end of the fuselage panel 12, and is arranged to interlock with the notch 30 of the wing panel 14 and the slot 46 of the weight holder 18, to secure and strengthen the components of the aircraft. Situated between fuselage tabs 20 and 22 is an arch-like recessed area 21. When the fuselage panel 12 is assembled with the wing panel 14 and the weight holder 18, the recessed area 21 fits over and receives the weight-seating chamber 38*b*, as shown in FIG. 2. The positioning of chamber 38*b* within recessed area 21 attains a compact assemblage, i.e. it results in a snug and secure fit of the holder 18 with the fuselage and the wing panels. It also enhances the secure attachment of the weight holder 18 to the aircraft.

Figure 3:
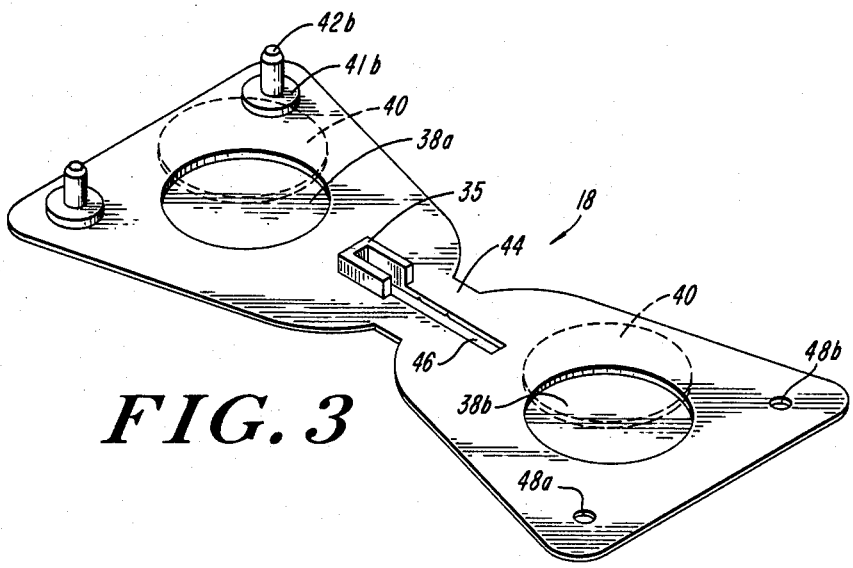
FIG. 3 is an isometric view of the weight holder shown in FIGS. 1 and 2, in the open position.
Figure 4:
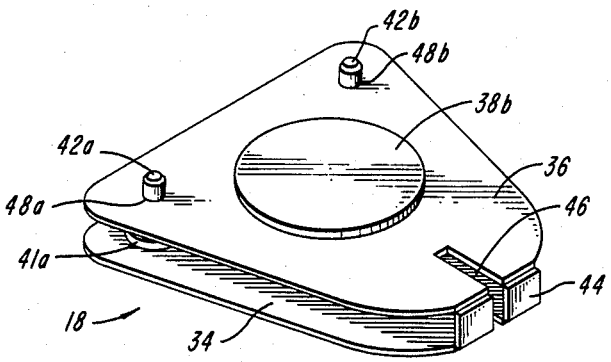
FIG. 4 is an isometric view of the weight-holding device shown in FIG. 3, in the closed position.
Figure 5:
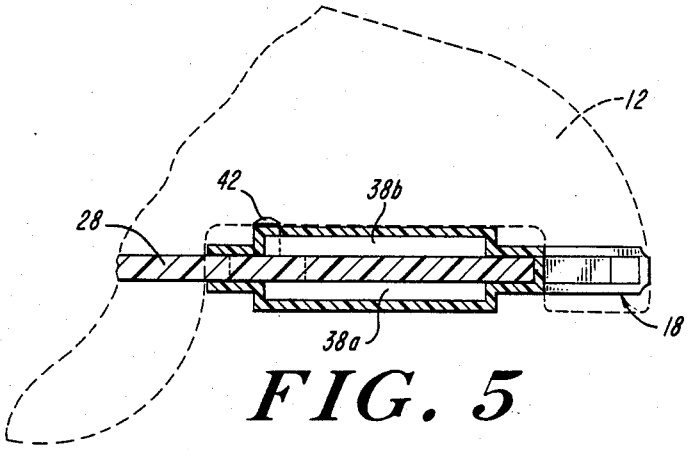
FIG. 5 is a side, cross-sectional view of the weight-holding device of FIGS. 1–4 taken along section line 5—5 of FIG. 2 and showing the fuselage panel in phantom.

With reference to FIGS. 3, 4, and 5, the weight holder 18 is a relatively flat, lightweight article. The weight holder 18 has two opposed clamping jaws 34, 36, which are joined by a hinge portion 44. When laid flat in the open position as shown in FIG. 3, the weight holder 18 assumes a substantially butterfly-like shape. The illustrated weight holder 18 is preferably a one-piece, lightweight, molded plastic device. The polymeric material of which the weight holder preferably is made may be readily selected by one skilled in the art, and an example of such a material is polystyrene-butadiene copolymer, also known as K-resin.

Referring to FIG. 3, each clamping jaw 34, 36 has a weight-seating chamber 38*a*, 38*b*, respectively, for receiving a weighted object 40. The chambers 38*a*, 38*b* are preferably recesses in the interior surfaces of the jaws, and preferably are centrally located on the jaw surface. The interior surfaces are those shown in FIG. 3, that is, the surfaces which will face each other upon folding the weight holder to the position shown in FIG. 4. One alternative is to form each chamber 38*a*, 38*b* by a circular ridge or collar which rises above the jaw surface, instead of the preferred structure wherein the chambers are recessed in the interior surface.

The outer edge of clamping jaw 34 carries two upstanding, adjacent prongs 42*a* and 42*b* which secure the weight holder to the wing panel. At the base of each prong 42*a*, 42*b* is a circular boss 41*a*, 41*b*, respectively. Each boss 41*a*, 41*b* has a diameter substantially larger than that of the prongs 42*a*, 42*b*. Clamping jaw 34 also has a u-shaped raised ridge 35 mounted along the perimeter of slot 46. The other jaw 36 has two correspondingly located apertures 48*a* and 48*b* that receive and retain the prongs, to maintain the holder 18 in the clamped position of FIGS. 2, 4 and 5. More particularly, to mount the weight holder to the wing, prongs 42*a* and 42*b* and bosses 41*a* and 41*b* are inserted into wing apertures 32*a*, 32*b*, and clamping jaw 36 is folded about hinge 44 to place it in registration with clamping jaw 34, with the nose portion 28 of wing panel 14 sandwiched between the jaws. Apertures 48*a* and 48*b* receive the prongs 42*a* and 42b with an interference fit and thereby securely retain the prongs. The preferred engagement, however, is removable and replaceable. Before securing the weight holder 18 to the wing, however, a weighted object 40 may be inserted in either or each of the chambers 38*a*, 38*b*.

In assembling the aircraft of this invention it is preferred to first secure the weight holder 18 to the nose portion 28 of the wing as described above. The weight holder is mounted to the wing such that slot 46 of the weight holder is aligned with notch 30 of the wing. The weight holder is further secured as ridge 35 is held, in forced fit, within notch 30, and bosses 41*a* and 41*b* are maintained in forced fit within apertures 32*a*, 32*b*, respectively. Once the weight holder has been mounted to the wing, the fuselage 12, including the tail stabilizer 16, may be attached to the wing 14. As shown in FIG. 1, fuselage tab 22 is inserted through central wing slot 31 and fuselage forward tab 20 interlocks with the space formed by the alignment of slot 46 with notch 30. Forward tab 20 may be flush 3 with jaw 34, or may extend slightly below jaw 34.

In other embodiments of this invention, the wing notch 30 may be omitted, and thus the forward tab 20 would interlock only with the weight holder slot 46 and rest on the wing panel. Alternatively, the weight holder slot 44 may extend only through jaw 36, and not through jaw 34, leaving the forward tab 20 to interlock with the space formed by the alignment of notch 30 and slot 46, thus resting on solid jaw 34.

Although the weighted object 40 of this invention is preferably a penny, it is understood that washers, other coins or similar flat, circular objects may be used. A weighted object 40 may be placed in either one or both of the chambers. Further, if the weighted object is placed in only one chamber, it may be located in either the chamber above or below the wing panel. The choice of the site of the weighted object and the location of the weighted object will depend largely on the flight characteristics one desires to obtain.

In a further alternate embodiment of this invention (not shown), only one clamping jaw of the weight holding means has a weight-seating chamber. In such an embodiment the weighted object may be loaded into the recess to be either above or below the wing panel. Once again, the choice of the site of the weighted object and the location of the weighted object will depend largely on the flight characteristics one desires to obtain.

In yet another embodiment, the weight holder may be clamped to the fuselage panel, rather than to the wing panel. The above disclosure enables one skilled in the art to practice this alternative.

Although particular embodiments of this invention have been described and illustrated herein, it is recognized that modifications and variations may readily occur to those skilled in the art. Consequently, it is intended that the claims be interpreted to cover such modifications and equivalents.

What is claimed is:

1. In a toy aircraft having a fuselage panel normally oriented vertically and having means for mating to a wing panel, and at least a first wing panel normally oriented horizontally, said wing panel removably and replaceably matable with said fuselage panel, the improvement comprising weight holding means with opposed and conjoined first and second clamping jaw members, said jaw members being joined by hinge means, said weight holding means being removably and replaceably mounted upon one said panel, and at least one of said jaw members having a weight seating chamber for removably and replaceably receiving a weighted object and fixedly securing it to said aircraft at a selected location thereon.

2. In an aircraft according to claim 1, the further improvement wherein said weight-holding means is a device formed of a unitary construction, and wherein said weight-holding means is mounted to one said panel by folding said opposed jaws about said hinge means such that said jaws are in clamping registration with one another, with said panel secured therebetween.

3. In an aircraft according to claim 2, the further improvement wherein said weight holding means is secured to one said panel by at least one prong on said first jaw which extends through at least one corresponding aperture in said panel to become removably and replaceably engaged in at least one corresponding aperture in said second jaw.

4. In an aircraft according to claim 3, the further improvement wherein said weight holding means is mounted to said wing panel.

5. In an aircraft according to claim 4, the further improvement wherein a recessed area in said fuselage lies between a forward tab means and a central tab means of said fuselage panel, said recessed area forming means for seating one surface of said weight-holding means, the weight-holding means being further engaged by said forward tab means.

6. In an aircraft according to claim 5, the further improvement comprising a flat, circular weighted object securely seated in said chamber of said weight holder.

7. In an aircraft according to claim 6, the further improvement wherein said weighted object is a coin-like object.

8. A removable and replaceable weight holder integrally mountable to a toy aircraft having interfitting wing and fuselage panels, said holder comprising opposed first and second clamping jaw members and hinge means joining said jaw members, means, for mounting said jaws to one of said panels, and at least one of said jaw members having a weight seating chamber for removably and replaceably receiving a weighted object and securing it to said aircraft at a selected location thereon.

9. The weight holder of claim 8 wherein said weight holder is a device formed of a unitary construction.

10. The weight holder of claim 9 wherein said weight holder further comprises at least one prong on said first jaw member and at least one aperture in said second jaw member wherein said jaws are folded about said hinge such that said jaws are in registration with one another, and said weight holder is closed by removably and replaceably engaging said prong in said aperture.

11. A weight holder according to claim 10 further comprising a flat, circular weighted object seated in said chamber of said weight holder.

12. A weight holder according to claim 10 wherein said weighted object is a coin-like object.

* * * * *